United States Patent [19]

Buzza

[11] 3,985,235

[45] Oct. 12, 1976

[54] CENTER FILLER, CENTER PLATE CONSTRUCTION FOR RAILWAY VEHICLES

[75] Inventor: Richard S. Buzza, Pittsburgh, Pa.

[73] Assignee: Pittsburgh Forgings Company, Coraopolis, Pa.

[22] Filed: June 17, 1975

[21] Appl. No.: 587,551

[52] U.S. Cl. ..... 213/57; 105/199 C; 105/420

[51] Int. Cl.[2] ..... B61F 5/16

[58] Field of Search..... 213/57; 105/420, 199 C, 105/199 R

[56] References Cited

UNITED STATES PATENTS

| | | | |
|---|---|---|---|
| 2,180,799 | 11/1939 | Cottrell et al. | 213/57 |
| 2,355,524 | 8/1944 | Garlock et al. | 213/57 |
| 3,797,674 | 3/1974 | Reynolds | 213/57 |

*Primary Examiner*—Robert B. Reeves
*Assistant Examiner*—John P. Shannon
*Attorney, Agent, or Firm*—Webb, Burden, Robinson & Webb

[57] ABSTRACT

A fabricated center filler and center plate construction for the underframe of a railway car in the area where the body bolster intersects the center sill. The fabricated center filler includes four interconnected, vertical walls and a bottom floor plate secured by welding thereto. The center filler is secured by welding to the vertical sidewalls of the center sill with the floor plate of the center filler positioned flush with the lower surfaces of the center sill flanges. Opposed ends of the center filler floor plate preferably are overlapped by portions of the bottom cover plate of the bolster and are secured by welding hereto. A king pin receiving tube is secured by welding within a hole formed in the floor plate of the center filler, the tube having its upper end positioned within the confines of the center filler and having its lower end positioned below the floor plate. Bracing means, preferably in the form of plate members, are angularly disposed within the center filler and secured by welding to the upper end of the king pin tube and to the walls of the center filler. The disclosed combination further includes a center plate having an outwardly extending bowl portion with a central hole formed therethrough to receive the lower end of the king pin tube therewithin to provide a mechanical interlock between the center filler and center plate. The upper surface of the center plate, surrounding the king pin tube, bears against the floor plate of the center filler while opposed upper edge portions of the outer periphery of the center plate bear against the flanges of the center sill and against the floor plate of the center filler, respectively. The center plate is secured to the center filler floor and king pin tube and also to the center sill flanges preferably by way of exposed weld beads which permit torch removal of the welds whereby a damaged or worn center plate may be replaced without removing the center filler from the center sill.

9 Claims, 8 Drawing Figures

CENTER FILLER, CENTER PLATE CONSTRUCTION FOR RAILWAY VEHICLES

BACKGROUND OF THE INVENTION

The underframe of a railway freight car generally includes a longitudinally extending center sill with transverse body bolsters intersecting the center sill and outwardly extending therefrom. The transverse body bolsters are positioned near the ends of the car underframe above the area where the wheeled truck assemblies are located. The transverse body bolsters are attached to the center sill and apply a great loading force to the vertical sidewalls of the center sill. In order to prevent the collapse of the center sill walls due to this loading a center filler is secured within the center sill in the area adjacent the body bolster. A center plate is also secured to the underframe, beneath the center filler, which makes pivotal engagement with a mating center bowl on the bolster of the wheeled truck assembly.

Heretofore, it has been common to combine the center filler and center brace into a unitary cast structure. While this unitary casting approach provides a structurally strong center filler, it has several inherent shortcomings. The integral center filler, center plate castings are naturally costly to manufacture due to the extensive coring required and the resultant structures are also quite heavy. Further, due to the dynamic loading conditions present during use, the center plates become worn or cracked and must be replaced periodically. In the integral cast structures, the entire unit must be removed from the center sill in order to replace the center plate, even though the center filler may be in workable condition.

In order to overcome the shortcomings of the integral cast structures, separate center filler and center plate constructions have come into usage in the art. In these constructions, the center filler is generally cast and has a cast or forged center plate, welded, bolted or riveted, either directly or indirectly thereto. Other variations have also been suggested involving cast-weld center filler, center plate constructions. Examples of these various prior art proposals are set forth in U.S. Pat. Nos. 2,003,341; 2,078,176; 2,995,258; 3,670,662; 3,770,139; and 3,797,674.

While the separate center filler, center plate proposls of the prior art have provided the desired feature of easy removal and replacement of the center plate bowl, these structures still have inherent shortcomings. A well braced, cast, center filler is expensive to manufacture due to the intricate coring required in the molding process and such structures are, likewise, correspondingly heavy. Less expensive castings require less coring but these do not provide proper rigidity and stress distribution in the center filler structure. In the typical underframe assembly, the top edges of the center filler casting contact the top wall of the center sill and the center plate is riveted to the bottom of the center filler and riveted to the body bolster by way of its extended tie plate. The variations in dimensional tolerances in the depth of the center sill and height of the cast center filler often results in a poor fit-up between the center filler and center plate due to the fact that the center filler may not be flush with the lower flanges of the center sill. This poor fit-up causes the center plate to flex until it receives back up from the center filler by which event there results an overstressed condition at the juncture of the center plate and its tie plate. This problem, sometimes, referred to as "tin-canning" in the art, caused by a poorly backed up center plate, has heretofore caused the early and chronic failure of the center plate.

The railway industry standards have recently required in certain instances that the bottom of the center filler and the center sill flanges be machined flat after installation so that flush surfaces result. These same standards also require the flat machining of the center plate and tie plate in order to assure a face-to-face fit in order to eliminate the tine-canning problem. It is, of course, appreciated that this required machining operation is costly in that it is time consuming and requires special machinery.

The invention disclosed and claimed herein solves many of the problems heretofore encountered in the design and construction of center filler, center plate structures.

SUMMARY OF THE INVENTION

The invention is directed to a combined, center filler and center plate construction in which the center filler is formed of fabricated plate-like members providing a cost and weight savings over prior cast center fillers without any sacrifice in strength.

The invention further provides a king pin tube extending between the floor plate of the center filler and the center plate. The king pin tube provides a mechanical interlock between the center filler and center plate which resists transverse shear stresses on the assembly. The king pin tube further forms a portion of the bracing within the center filler providing structural support to resist vertical loading forces on the assembly.

The invention still further provides a center filler which is mounted within the center sill of the car underframe wherein the upper edges of the center filler sidewalls are spaced apart from the closed top of the center sill with the center filler floor plate positioned flush with the lower flanges of the center sill. This permits the center plate to be welded directly to the center sill flanges and directly to the center filler floor plate which eliminates the necessity of machining the center filler, center plate assembly to achieve a flat fit.

The fabricated center filler of the invention also includes a rectangular floor plate which is secured to the center sill and to the bottom cover plate of the body bolster which provides improved stress distribution and structural integrity of the weld joints.

Briefly, the invention provides a combined, fabricated center filler and center plate construction adapted for use in the center sill of a railway car underframe. The center filler preferably comprises a four-walled, box-like structure having a bottom floor plate weldably secured thereto. The floor plate is generally rectangular in shape having a width substantially equal to the transverse spacing between the sidewalls of the center sill and a length preferably greater than the spacing between the transverse walls of the center filler. The center filler is fitted within the center sill of the car underframe and weldably secured to the vertical sidewalls of the center sill preferably by way of weld slots formed through the center sill sidewalls. The center filler is positioned such that the floor plate is flush with the lower surfaces of the center sill flanges. The edge portions of the floor plate extending beyond the transverse walls of the center filler overlap or are overlapped by the bottom cover plate of the body bolster and are secured by welding thereto. A king pin receiving tube is secured by welding within a hole formed in the floor plate of the center filler. The upper end of the tube is positioned within the confines of the center filler and its bottom end terminates beyond the floor plate. Bracing means, preferably in the form of a plurality of plate members, is disposed within the center filler and secured by welding to the upper portion of the king pin tube and to the center filler. Also provided is a center plate having an outwardly extending bowl portion with a central hole formed therethrough to receive the lower end of the king pin tube therein. The central portion of the center plate surrounding the king pin tube bears directly against the floor plate of the center filler while opposed edge portions of the outer periphery of the center plate bear directly against the flanges of the center sill and bear directly against the floor plate of the center filler, respectively. The center plate is secured to the center filler floor and to the king pin tube and also to the center sill flanges by way of exposed weld beads to permit the removal and replacement of a damaged or worn center plate without removing the center filler from the center sill.

BRIEF DESCRIPTION OF THE DRAWINGS

For a better understanding of the objects and advantages of the invention, reference is made to the drawings, in which.

DETAILED DESCRIPTION OF THE INVENTION

Figure 1:
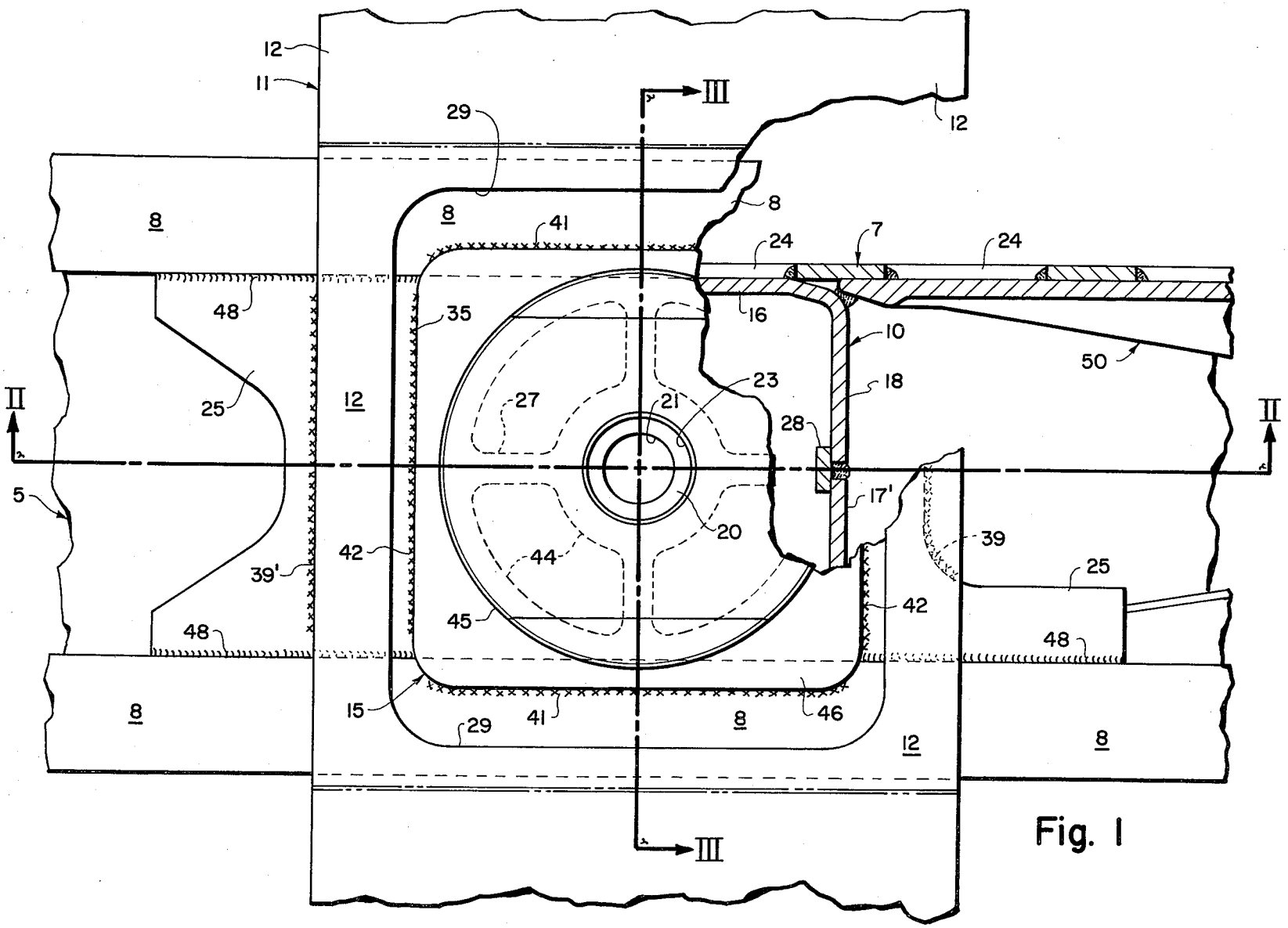
FIG. 1 is a plan view of the underside of a railway car showing the area of intersection between the center sill and body bolster with a partial fragmentary view of the center plate and center filler of the present invention mounted thereto.
Figure 2:
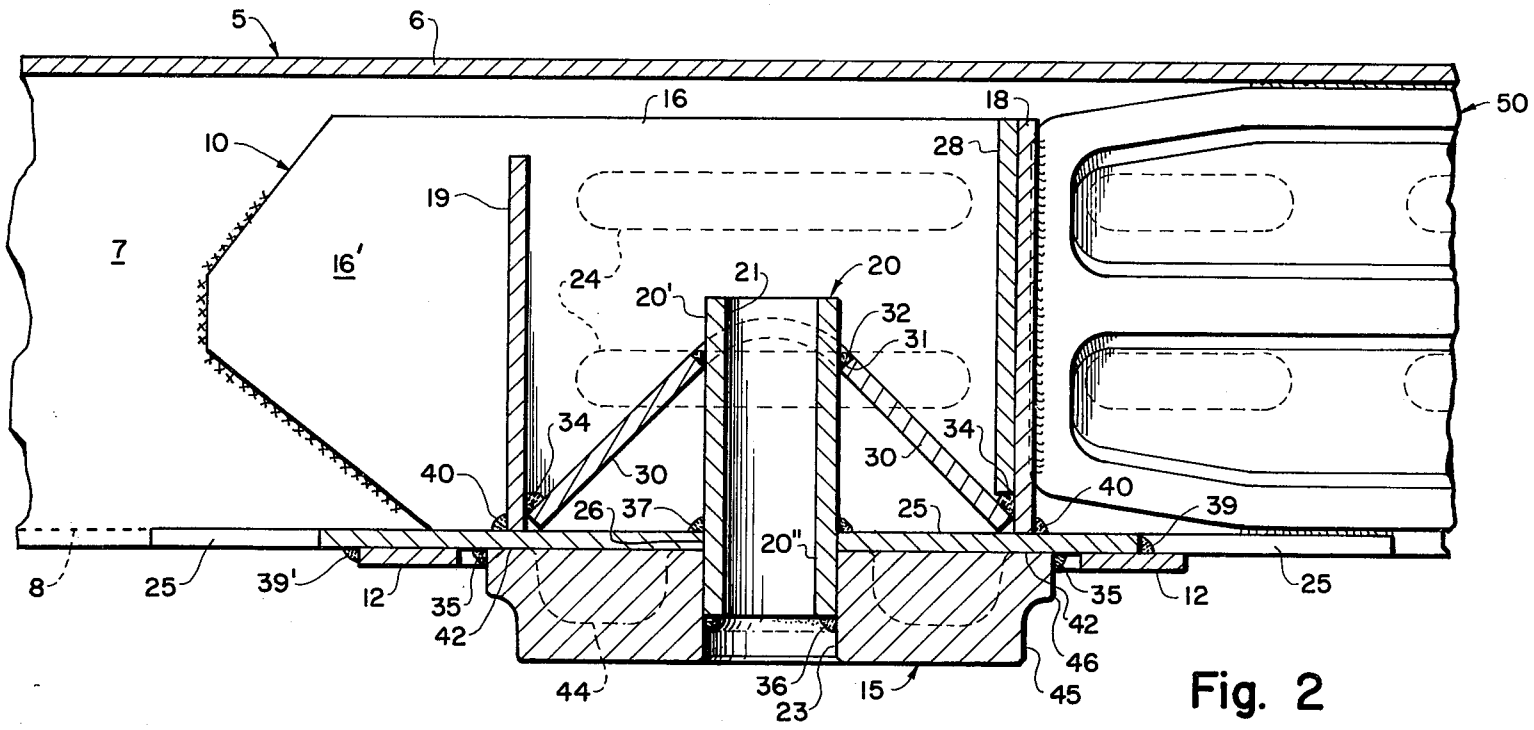
FIG. 2 is a sectional elevation taken along line II—II in FIG. 1.
Figure 3:
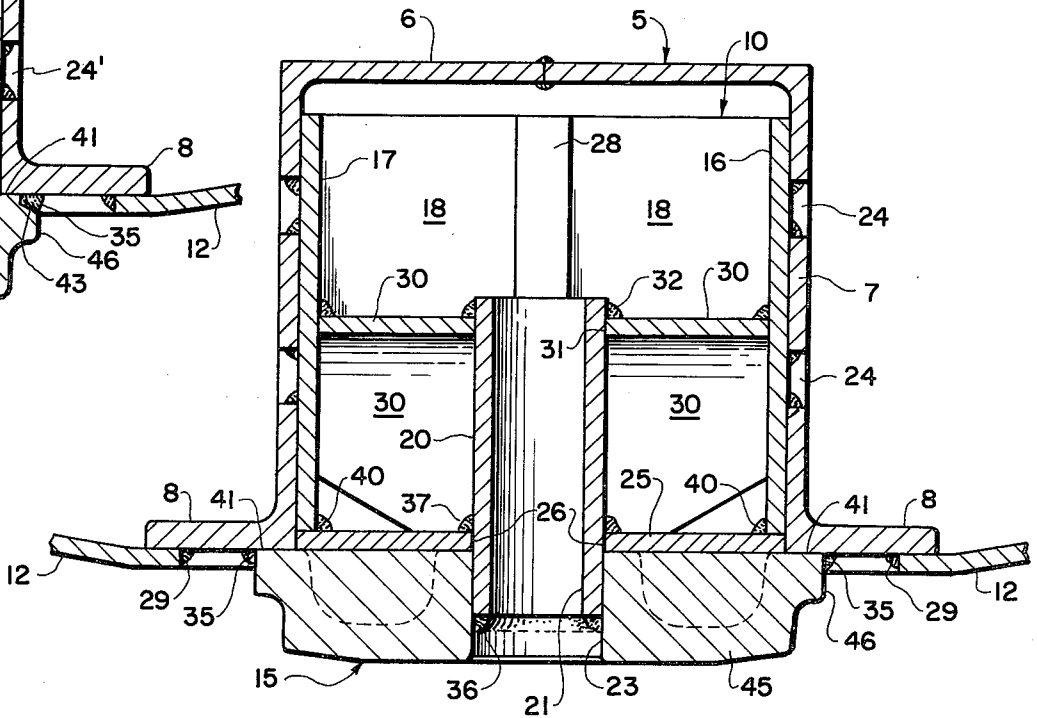
FIG. 3 is a sectional elevation taken along line III—III of FIG. 1.

One presently preferred embodiment of the invention is shown in FIGS. 1 through 3, in which the center plate is designated generally as 15 and the center filler construction is generally designated as 10. The center plate 15 and center filler 10 are situated at the intersection of transverse body bolster 11 and longitudinally extending center sill 5. Conventional center sill 5 comprises a closed top 6 with vertical sidewalls 7 and integral, lower feet or flanges 8. Center filler 10 is a fabricated plate construction as compared with the cast center fillers commonly employed in the prior art. Center filler 10 comprises a first pair of upstanding walls 16 and 17 which extend longitudinally along center sill 5 adjacent the sidewalls 7 thereof. A second pair of upstanding walls 18 and 19 extend transversely across the center sill and are connected to walls 16 and 17. In the embodiment depicted in FIGS. 1 through 3, transverse wall 19 is a unitary flat plate while longitudinal walls 16, 17 and transverse wall 18 are formed of two L-shaped plates, each having a right angled bend, which, when joined form transverse wall 18 therebetween see FIG. 1. The pieces are preferably joined by welding with the use of weld back-up plate 28 at the vertical center line of wall 18. It will be apparent to those skilled in the art that the walls of the center filler may be fabricated in various ways. For example, the walls may be formed of four separate plate members or the walls 16, 17 and 18 may be formed of a single plate member bent in a generally U-shaped configuration. In the assembled condition, the walls form a box-like arrangement with longitudinal sidewalls 16 and 17 spaced apart a distance substantially equal to the spacing between the vertical sidewalls 7 of center sill 5. A center filler floor plate 25 is secured by welding to the lower edges of walls 16, 17, 18 and 19. Floor plate 25 is generally rectangular in shape having a transverse width substantially equal to the spacing between vertical sidewalls 7 of the center sill. The floor plate 25 preferably has a longitudinal length greater than the spacing between transverse sidewalls 18 and 19 such that when assembled it may overlap the lower cover plate 12 of the body bolster, FIG. 2. The longitudinal dimension of the floor plate is an approximation of normal bolster width, with the purpose of providing continuity of the bolster construction. The cover plate, if used, may or may not overlap the floor plate. Floor plate 25 has a central hole 26 formed therethrough to receive a king pin tube 20 therein. King pin tube 20 has bore 21 which is adapted to receive the king pin of the wheeled truck assembly therein, and an upper end 20' which is positioned within the interior of center filler 10 and a lower end 20'' which is positioned beyond floor plate 25. King pin tube 20 is secured by welding at 37 to floor plate 25.

In the embodiment shown in FIGS. 2–3, center filler 10 includes a unitary bracing plate 30 which is bent at approximately 90° having a hole 31 formed at its mid-portion through the bend line. Bracing plate 30 has a width substantially equal to the transverse spacing between sidewalls 16 and 17 of the center filler and is fitted onto king pin tube 20 and secured by welding to upper portion 20' by way of weld 32. Plate 30 is, likewise, secured by welding to sidewalls 16 and 17 and to sidewalls 18 and 19. In addition to bracing king pin tube 20, bracing plate 30 further supports sidewalls 16 and 17 and sidewalls 7 of the center sill.

Center filler 10 is positioned within the center sill 5 such that the floor plate 25 of the center filler is flush with the lower surfaces of the center sill feet 8, FIGS. 2 and 3. As can be noted, side walls 16, 17, 18 and 19 of the center filler have a vertical height less than the interior height of the center sill. This feature permits the accurate placement of floor 25 relative to flanges 8 which might not be the case if the upper edges of the sidewalls of the center filler were to bear against top plate 6 of the center sill. As best seen in FIG. 1, floor plate 25 is secured by welding at 48 to the center sill 5 and to the bottom cover plate 12 of body bolster 11 at 39 and 39'. Bolster cover plate 12 naturally has a cut-out portion 29 therethrough in the area of the intersection of the center sill 5 and bolster 11 to provide sufficient clearance for the center plate 15. Bolster bottom cover plate 12 bears against the lower surfaces of the center sill flanges 8 and is welded thereto at cut-out 29. Since the lower surface of floor plate 25 is flush with the lower surface of flanges 8, the floor plate is also flush with the upper surface of bolster cover plate 12, FIG. 2. The rectangular shape of floor plate 25 thus permits it to be secured not only to the center sill 5 but also to bolster cover plate 12 at weld beads 39 and 39' which provides a more uniform distribution of stresses. Transverse sidewall 18 of center filler 10 may also be secured by welding to rear stop assembly 50. Assembly 50 forms no part of this invention.

As can best be seen in FIGS. 2 and 3, the sidewalls 16 and 17 of center filler 10 are secured by welding to the vertical sidewalls 7 of the center sill by way of weld slots 24 formed through sidewalls 7. As shown in FIG. 2, longitudinally extending wall plate 16 preferably contains a portion designated 16' which extends beyond transverse wall 19. The terminal edge of extended portion 16' is then welded to the vertical sidewall 7 of the center sill which naturally increases the structural integrity of center filler 10 due to the greater length thereof. Opposite longitudinal sidewall 17, not shown in FIG. 2, is also preferably formed with an extended portion similar to 16'.

Center bearing plate 15 is preferably drop forged and includes a generally square or rectangular mounting plate portion 46 and an outwardly extending bowl portion 45 integral therewith. The bowl portion 45 is adapted to make bearing contact with a mating dish portion mounted on the truck bolster (not shown). For strengthening purposes, the center plate 15 is provided with conventional radially disposed webs 27 which separate open cavities 44 therein. Center plate 15 further includes a central opening 23 which is fitted onto the lower end 20'' of king pin tube 20. The lower end 20'' of the king pin tube is welded at 36 to the bore 23 of the center plate, FIG. 2. In the assembled state, the upper surface portion of center plate 15 surrounding bore 23 bears directly against floor plate 25 of the center filler while opposed edges 41 bear directly against the lower surfaces of the center sill flanges 8, FIGS. 1 and 3. Opposed edges 42 of the center plate 15 bear directly against the lower surface of floor plate 25 of the center filler, FIGS. 1 and 2. Center plate 15 is welded along its outer periphery at 35 directly to the flanges 8 of the center sill and to the floor plate 25. Owing to the fact that floor plate 25 is flush with the lower surfaces of the sill flanges 8, there is no need to machine the surfaces of the assembly since the center plate 15 will bear directly against the center sill flanges 8 and floor plate 25. The direct fit-up of the center plate to the center filler and sill flanges also eliminates the need for tie plates or spacer plates as employed in the prior art.

The king pin tube 20 is structurally secured within the center filler by way of bracing plates 30 and weld beads 37 at the floor plate 25 and is secured to the center plate at weld beads 36. This king pin tube assembly yeilds a mechanical interlock between center filler 10 and center plate 15 which provides added resistance to transverse shear forces acting on center plate 15. King pin tube 20, being welded at 36 to center plate 15 and welded at 32 to bracing plate 30, likewise, affords additional reinforcement when vertical loading forces are applied to center plate 15.

Figure 6:
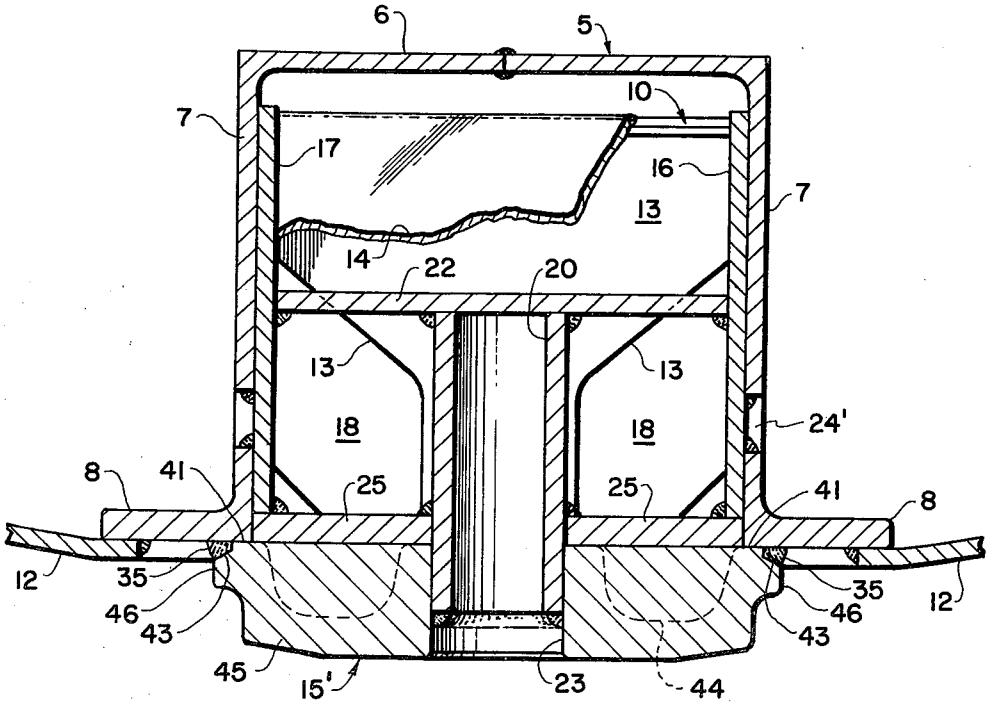
FIG. 6 is a sectional elevation taken along line VI—VI of FIG. 4.
Figure 4:
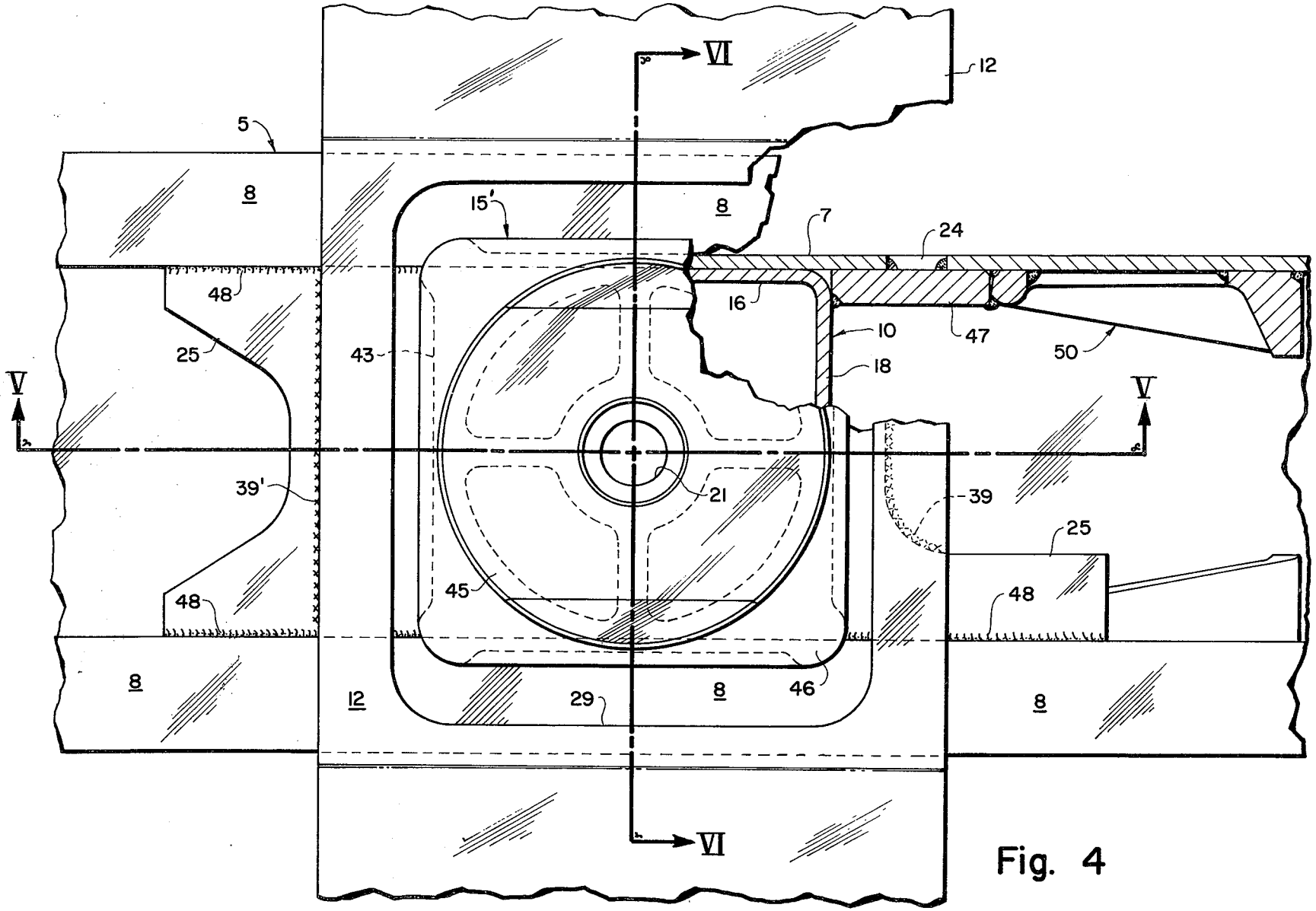
FIG. 4 is a plan view of the underside of the railway car frame similar to that of FIG. 1.
Figure 5:
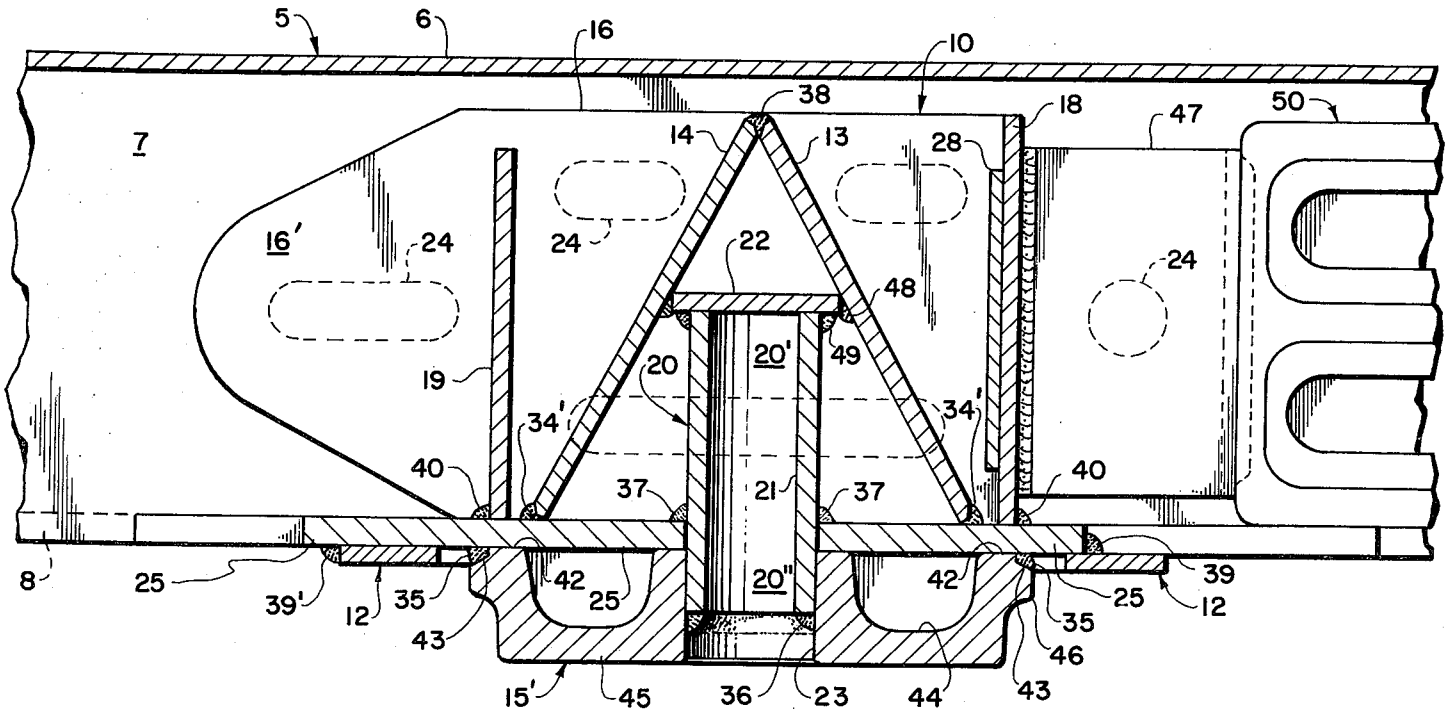
FIG. 5 is a sectional elevation taken along line V—V of FIG. 4.

Another presently preferred center filler bracing embodiment of the invention is shown in FIGS. 4, 5 and 6. In this embodiment, the plate means employed in bracing center filler 10 comprises two angularly disposed plate members 13 and 14, having a width equal to the spacing between walls 16 and 17, which are secured by welding at their upper edges at 38 and at their lower edges 34' to floor plate 25. A rectangularly shaped plate 22 is secured by welding to the top 20' of the king pin tube at 49. Rectangular plate member 22 has a length equal to the spacing between longitudinal sidewalls 16 and 17 of the center filler and is secured by welding at its end to sidewalls 16 and 17. Angularly disposed reinforcing plates 13 and 14 are secured by welding to plate member 22 along its lateral edges at 48 near the top of king pin tube 20. This bracing arrangement provides excellent transverse and vertical support for the center filler construction. The plates employed for the center filler and its bracking means may be press formed and, therefore, represent both a cost and weight savings over the cast center fillers of the prior art.

The center plate 15' depicted in FIGS. 4 through 6 also contains a weld groove 43 around its outer periphery to aid in the welding operation.

The weld beads 35 which secure the center plate to the center sill flanges 8 and to the floor plate 25 and the weld beads 36 which secure the central bore 23 of the center plate to the king pin tube 20 are preferably exposed. Exposed weld beads 35 and 36 are then easily removable by way of a lancing torch to permit the replacement of a damaged or worn center plate without the necessity of removing the center filler 10 from the center sill 5. A new center plate 15 may then be positioned and rewelded as previously described.

The center filler, center plate construction of this invention may be assembled and fitted into the underframe of the car in several ways. Railway cars are usually constructed with the underframe facing upwards and in this position the open, bottom end of the center sill is also facing upwardly for easy access. The center filler is fully fabricated prior to installation in the car. The center plate 15 is also preferably secured to the floor plate 25 of the center filler prior to the installation of the center filler in the car. After the center plate has been secured to floor plate 25 and to king pin tube 20, the center filler 10 is inserted into center sill 5. This is done with the bolster cover plate 12 removed from the body bolster since floor plate 25 overlaps bolster cover plate 12, FIGS. 1 and 4. Since the car is inverted, edge portions 41 of center plate 15 will bear against center sill flanges 8 thus aligning the floor plate 25 flush with the sill flanges, FIGS. 3 and 4. Center plate 15 may then be welded to sill flanges 8 as previously described and bolster cover plate 12 may then be laid in place and welded to bottom plate 25 of the center filler and to sill flanges 8. The sidewalls 16 and 17 of the center filler may also be welded at this time to sidewalls 7 of the center sill with the aid of weld slots 24.

While the above described assembly method is preferred due to its self-aligning features, it is obvious that the fabricated center filler could also be clamped within the center sill and welded. The center plate could then be dropped onto king pin tube 20 and the assembly welded.

Figure 7:
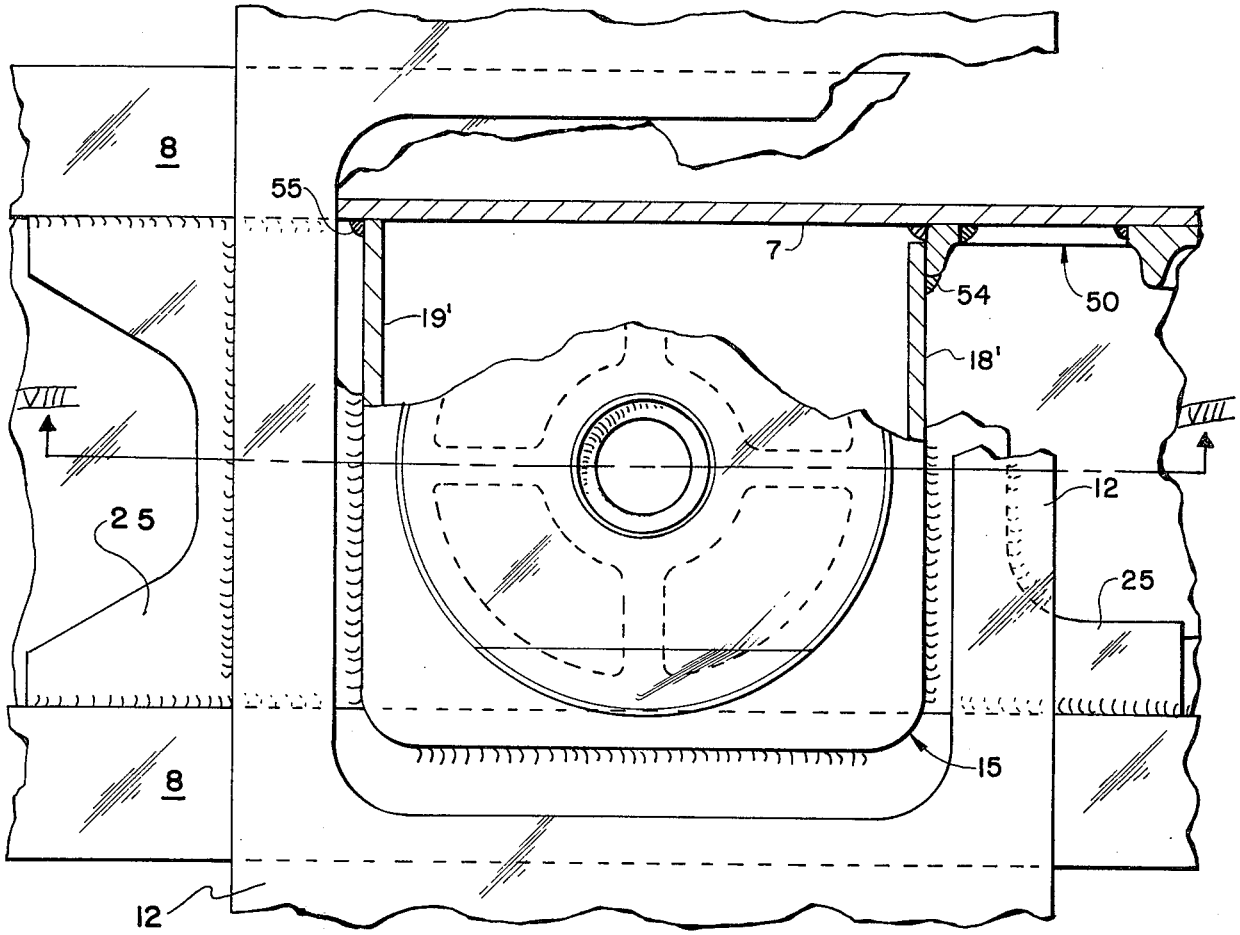
FIG. 7 is a plan view similar to that of FIGS. 1 and 4 showing an additional embodiment of the invention.
Figure 8:
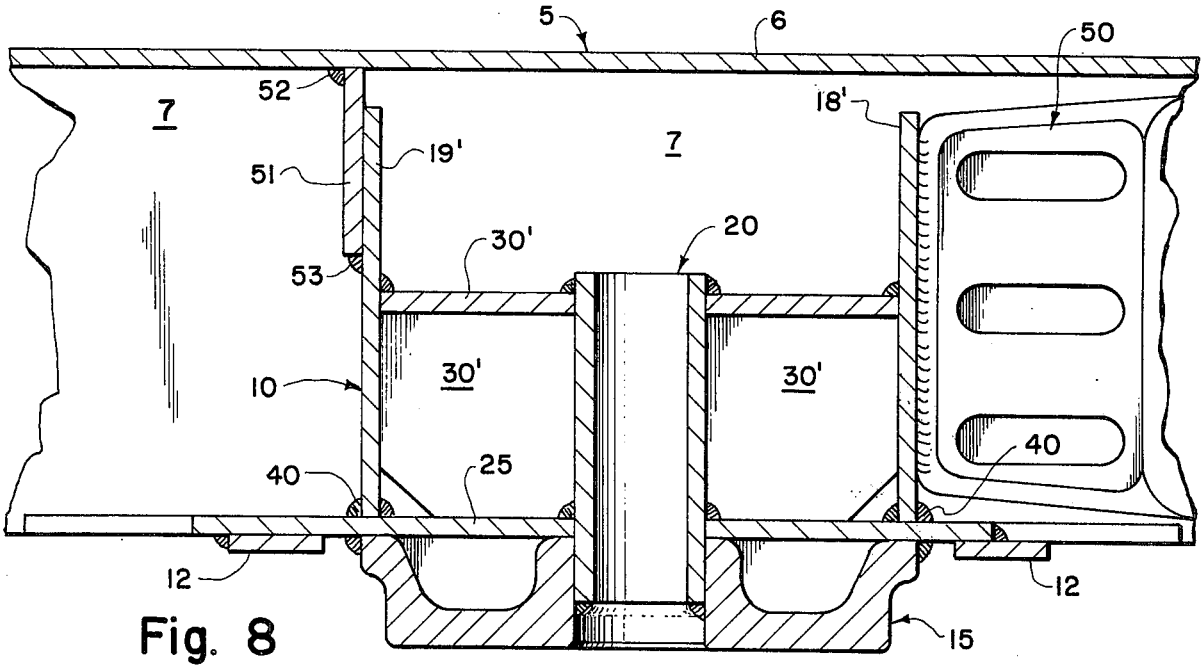
FIG. 8 is a sectional elevation taken along line VIII—VIII of FIG. 7.

An additional embodiment of the center filler 10 is shown in FIGS. 7 and 8. In this embodiment, the longitudinal sidewalls of the center filler, designated 16 and 17, in the previously described embodiments, are not employed. Instead, only a pair of spaced apart transverse wall plates 18' and 19' are used. Plates 18' and 19' are secured at their lower edges to floor plate 25 and extend transversely across the center sill 5. Transverse wall plates 18' and 19' have a length substantially equal to the width of center sill 5 to permit weld securement at their outer edges, either directly or indirectly, to sidewalls 7 of the center sill. As can be seen in FIG. 7, transverse wall 19' is welded directly to the center sill sidewall 7 at 55, while transverse wall 18' is indirectly secured to sidewall 7 by way of weld 54 to rear top assembly 50 which, in turn, is welded directly to sidewall 7. Of course, it is understood that transverse wall 18' could also be welded directly to sidewalls 7 if desired and, in such case, rear stop assembly 50 would preferably be spaced apart from wall 18' a sufficient distance to permit access to the joint for welding purposes.

As can be noted in FIG. 8, bracing plate 30' is rotated 90° from the earlier described embodiments, such that the axis of the bend line of plate 30' is parallel with the longitudinal axis of center sill 5. Plate means 30' is similar to the embodiment of FIGS. 2 and 3 and is secured by welding at its outer edges to transverse walls 18' and 19' and around its center hole to king pin tube 20. Plate 30' may also be welded at its lower edges to floor plate 25. The construction of FIGS. 7 and 8, while not as rigid as the embodiments of FIGS. 1–6, does provide adequate bracing required for most center filler applications and, at the same time, is lighter in weight and requires less welding and, hence is less costly to manufacture and install than the earlier described embodiments. If additional bracing is desired, stiffening plate 51 may also be employed. Plate 51 is secured by welding at 52 to top plate 6 of the center sill and secured by welding at 53 to transverse wall 19'. In order to insure a flush fit-up of the center plate 15 against the center sill flanges, transverse walls 18' and 19' are preferably shorter than the spacing between center sill flanges 8 and top 6 of the center sill, the same as in the previously described embodiments of the center filler. The installation of the center plate 15 to the king pin tube 20 and to floor plate 25 is, likewise, the same as previously described. Opposed edges of rectangular floor plate 25 may also extend outwardly and be overlapped by and secured by welding to the body bolster bottom cover plate 12 in those constructions where a continuous cover plate is employed, FIGS. 7 and 8.

While several of the presently preferred embodiments of the invention have been shown and described herein, it is apparent that certain modifications can be made without departing from the scope of the following claims.

I claim:

1. A center filler and center plate construction for the center sill and body bolster of a railway car, said center sill of the type having an open bottom and a closed top and a pair of spaced apart sidewalls depending downwardly from the top, each of the sidewalls carry an outwardly extending lateral flange on the lower edge thereof, said construction comprising:

A. a center filler including a first pair of upstanding, longitudinal walls spaced apart a distance substantially equal to the spacing between the sidewalls of the center sill, a second pair of upstanding, transverse walls extending between said first pair, a floor plate secured to the lower edges of said first and second pairs of walls to define a box shaped structure, said floor plate having a hole formed therethrough, a king pin tube secured within said hole and having an upper end positioned within the box shaped structure and a lower end spaced beyond the floor plate, said center filler secured within the center sill with the floor plate positioned flush with the flanges of the center sill;

B. a center plate including an outwardly extending, circular bowl portion having a central hole formed therethrough to receive the lower end of the king pin tube therein, upper edge portions of the center plate contacting the flanges of the center sill and the floor plate of the center filler, and means for securing said upper edge portions of the center plate to the center sill and center filler; and C. plate means secured within the box shaped structure for bracing said center filler and including a unitary plate member bent at an angle of about 90° and having a hole formed therethough at the bend line to receive the upper end of the king pin tube, said plate member secured by welding around said hole to the king pin tube and also secured by welding at its edge to portions of the center filler.

2. The center filler and center plate construction of claim 1 wherein the first pair of longitudinal walls of the center filler are welded to the sidewalls of the center sill by way of a plurality of welding slots formed through the center sill sidewalls.

3. The center filler and center plate construction of claim 1 wherein the center plate is drop forged and has a plurality of radially extending webs formed therein and surrounding said central hole, the area of the center plate adjacent the central bore contacting the floor plate of the center filler.

4. The center filler and center plate construction of claim 1 wherein the means for joining the center plate to the sill flanges and to the floor plate is exposed weld beads around the outer periphery of the center plate.

5. The center filler and center plate construction of claim 4 wherein the center plate has a weld groove formed on portions of its outer periphery.

6. The center filler and center plate construction of claim 1 wherein the first pair of longitudinal walls and one of the transverse walls of the center filler are fabricated from a pair of L-shaped plate members which are secured by welding together and the second transverse wall comprising a flat plate member.

7. The center filler and center plate construction of claim 6 wherein end portions of the longitudinal walls of the center filler extend beyond the second transverse wall plate thereof, said extended end portions of the longitudinal walls being secured by welding to the sidewalls of the center sill.

8. The center filler and center plate construction of claim 1 wherein the floor plate of the center filler is rectangular in shape, having opposed end portions which are overlapped by portions of the body bolster and secured by welding thereto.

9. A center filler and center plate construction for the center sill and body bolster of a railway car, said center sill of the type having an open bottom and a closed top and a pair of spaced apart sidewalls depending downwardly from the top, each of the sidewalls carry an outwardly extending lateral flange on the lower edge thereof, said construction comprising:

A. a center filler including a first pair of upstanding, longitudinal walls spaced apart a distance substantially equal to the spacing between the sidewalls of the center sill, a second pair of upstanding, transverse walls extending between said first pair, a floor plate secured to the lower edge of said first and second pairs of walls to define a box shaped structure, said floor plate having a hole formed therethrough, a king pin tube secured within said hole and having an upper end positioned within the box shaped structure and a lower end spaced beyond the floor plate, said center filler secured within the center sill with the floor plate positioned flush with the flanges of the center sill;

B. a center plate including an outwardly extending, circular bowl portion having a central hole formed therethrough to receive the lower end of the king pin tube therein, upper edge portions of the center plate contacting the flanges of the center sill and the floor plate of the center filler, and means for securing said upper edge portions of the center plate to the center sill and center filler; and C. plate means secured within the box shaped structure for bracing said filler and including a rectangular plate secured by welding to the top of the king pin tube and extending between and secured by welding to the first pair of longitudinal walls of the center filler, said means further including a pair of angularly disposed plates joined together by welding at their upper edges and joined to the floor plate of the center filler at their lower edges and to lateral edges of the rectangular plate near the top of the king pin tube.

* * * * *

UNITED STATES PATENT OFFICE

CERTIFICATE OF CORRECTION

PATENT NO. : 3,985,235

DATED : October 12, 1976

INVENTOR(S) : Richard S. Buzza

It is certified that error appears in the above-identified patent and that said Letters Patent are hereby corrected as shown below:

Column 2 Line 12 --tine-canning-- should read "tin-canning".
Column 3 Line 59 After --is-- insert "of".
Column 4 Line 62 After --29-- insert "formed".
Column 4 Line 68 --surface-- should read "surfaces".
Column 5 Line 45 Delete "the".
Column 6 Line 7 --end-- should read "ends".
Column 6 Line 13 --bracking-- should read "bracing".
Column 7 Line 7 --top-- should read "stop".

Claim 1 - Column 8 Line 19 --edge-- should read "edges".
Claim 6 - Column 8 Line 43 --comprising-- should read "comprises".
Claim 9 - Column 8 Line 67 --edge-- should read "edges".

Signed and Sealed this

Fourteenth Day of December 1976

[SEAL]

*Attest:*

RUTH C. MASON
*Attesting Officer*

C. MARSHALL DANN
*Commissioner of Patents and Trademarks*